United States Patent [19]

Barsumian

[11] Patent Number: 4,926,486

[45] Date of Patent: May 15, 1990

[54] TRANSDUCER ASSEMBLY FOR AUTOMATIC MESSAGE SYSTEM

[76] Inventor: Bruce R. Barsumian, 890 Dago Rd., Cookeville, Tenn. 38501

[21] Appl. No.: 287,511

[22] Filed: Dec. 19, 1988

Related U.S. Application Data

[63] Continuation of Ser. No. 74,928, Jul. 17, 1987, abandoned.

[51] Int. Cl.[5] ..... H04R 9/06

[52] U.S. Cl. ..... 381/152; 381/197

[58] Field of Search ..... 381/152, 150, 162, 183, 381/205, 194, 197, 202, 204; 340/706, 365 C

[56] References Cited

U.S. PATENT DOCUMENTS

| | | | |
|---|---|---|---|
| 1,716,057 | 5/1929 | Decaux . | |
| 1,893,049 | 1/1933 | Boudette | 381/197 |
| 1,997,051 | 4/1935 | Engholm . | |
| 2,289,962 | 7/1942 | Hancock . | |
| 2,341,275 | 2/1944 | Holland | 381/152 |
| 3,236,958 | 2/1966 | Cohen . | |
| 3,293,379 | 12/1966 | Gorike . | |
| 3,356,796 | 12/1967 | Wray . | |
| 3,366,749 | 1/1968 | Ries . | |
| 3,382,588 | 5/1968 | Serrell et al. | 340/365 C |
| 3,430,007 | 2/1969 | Thielen . | |
| 3,524,027 | 8/1970 | Thurston et al. . | |
| 3,609,253 | 9/1971 | Askworth . | |
| 3,728,497 | 4/1973 | Komatsu . | |
| 4,336,425 | 6/1982 | Renkus . | |
| 4,551,849 | 11/1985 | Kasai et al. | 381/152 |

FOREIGN PATENT DOCUMENTS

| | | | |
|---|---|---|---|
| 2143975 | 2/1985 | United Kingdom | 340/706 |

*Primary Examiner*—Alvin Oberley

*Attorney, Agent, or Firm*—Luedeka, Hodges & Neely

[57] ABSTRACT

An automatic message system employs a transducer to provide sound reproduction through a sounding surface which is isolated from the environment, as in museum display cases and the like or in outdoor displays. The sounding surface can be any semicompliant surface, including glass, and the system can be switched by means of a remote sensor which may act through the sounding surface. The device may be removably mounted on the sounding surface by use of suction cups or other devices. The sound reproduction system eliminates conventional speaker diaphragms, which may be damaged by weather or abuse. A stiff inverted cone is used to transmit the sound vibrations from the voice coil of the transducer directly to the sounding surface for amplification.

22 Claims, 2 Drawing Sheets

TRANSDUCER ASSEMBLY FOR AUTOMATIC MESSAGE SYSTEM

This application is a continuation of application Ser. No. 074,928, filed July 17, 1987, now abandoned.

FIELD OF THE INVENTION

The present invention relates to sound reproduction devices and particularly to sound reproduction devices for automatic message systems.

BACKGROUND AND SUMMARY OF THE INVENTION

Devices used to convert electrical signals to sound, i.e., "loud speakers", typically use a plurality of interacting magnetic fields to vibrate a sound producing baffle. The magnetic fields may be either opposing or complimentary. Typically a voice coil (electromagnet) is used to convert current flow to magnetism. The voice coil is attached to the baffle and is suspended in a magnetic field generated by a permanent magnet. The voice coil is either pushed into or pulled out of the magnetic field generated by the permanent magnet depending on the electrical polarity of the current impressed upon the voice coil. The vibration thus imparted to the voice coil is transmitted to the baffle. The sound producing baffle is typically a thin flexible diaphragm. The movement of the flexible diaphragm imparts the same vibrations to the surrounding air, thus generating sound. This above principle has been widely used for many years in convention speakers, headphones and microphones.

This conventional loud speaker system has found many applications. However, in some applications it would be preferred to use a system which eliminates some of the structure of the conventional loud speaker, for example, the flexible diaphragm. Flexible diaphragms are typically fibrous paper like material which deteriorates from exposure to the elements, such as moisture and extremes in temperatures.

In addition, the typical speaker system normally requires the use of a remote switch to activate the source of audio signals. These switches must be positioned at a place where they are accessible to those wishing to use the system. This often means that the switch and the wiring required to transmit the signal to the source of audio signals are also exposed to the elements and abuse.

A further characteristic of the conventional speaker system is that it is typically made up of separate elements, e.g., loud speaker baffle, switches and audio signal source, which must be assembled and wired into a complete system, engendering additional expense in installation cost. Such systems are not compact and easily movable from one location to another once installed. To move the installation to another location requires reversal of the installation procedure and subsequent reinstallation.

Applicant has produced a sound producing system which eliminates the conventional speaker baffle. In applicant's device, sound is transmitting to a sounding surface, such as a glass panel, by the use of a rigid vibration producing or transmitting baffle. The vibration transmitting baffle is preferably a semi-rigid material and is positioned in immediate contact with a sounding surface. Typically, applicant's entire device is attached to the sounding surface with the attaching devices and the cone in contact with the sounding surface. Applicant's device is contained in a compact housing and includes a conventional permanent field magnet and an electromagnetic voice coil positioned adjacent to the field magnet and in the influence of the magnetic field generated by the field magnet. The voice coil is connected to the vibration transmitting baffle so that motion of the voice coil is transferred directly to the vibration transmitting baffle.

In applicant's preferred embodiment, the voice coil is mounted coaxially with the vibration transmitting baffle. The vibration transmitting baffle is connected to the voice coil and restrains the motion of the voice coil. Motion of the voice coil is restricted to linear motion along the axis of the voice coil. In this embodiment it is possible to position the voice coil closely adjacent to the field magnet so that the air gap, and resulting losses, are minimized. This close relationship is possible due to the restraining effect of the vibration transmitting baffle which prevents wobble and transverse motion of the voice coil, and prevents contact between the voice coil and the field magnet.

It is a feature of applicant's preferred embodiment that the vibration transmitting baffle is conical in shape. The vibration transmitting baffle converges in an outwardly extending direction. Only a small central portion of the vibration transmitting baffle actually makes contact with the sounding surface. The vibration transmitting baffle is stiffened by the use of ribs so that flexure of the baffle is minimized and precise transference of the vibratory motion from the voice coil through the baffle to the sounding surface is achieved. The vibration transmitting baffle is preferably coaxial with the voice coil, so that its motion coincides as precisely as possible with that of the voice coil.

It is preferred that the housing of applicant's device be formed of some convenient to manufacture material, such as a plastic resin which can be injection molded or fabricated by a similar process. With this construction it is possible to produce a housing in which the vibration transmitting baffle is formed integrally with the housing. In this form, the vibration transmitting baffle can be further stabilized against transverse motion, that is motion transverse to the axis of the voice coil. The housing and vibration transmitting baffle are formed with an integral bellows structure at the juncture between the vibration transmitting baffle and the housing itself. This bellows, which preferably extends completely around the outer periphery of the vibration transmitting baffle, permits translatory motion along the axis of the voice coil and of the vibration transmitting baffle, but resists transverse motion.

Although reference is frequently made to the sound transmitting capabilities of the present sound transducer, it is understood that the transducer may also be used to receive sound. In such case the received sound message is recorded or retransmitted with conventional electronics.

The invention may be further understood by reference to the attached drawings and the following description of the drawings and description of the preferred embodiments.

DESCRIPTION OF THE PREFERRED EMBODIMENTS

Figure 1:
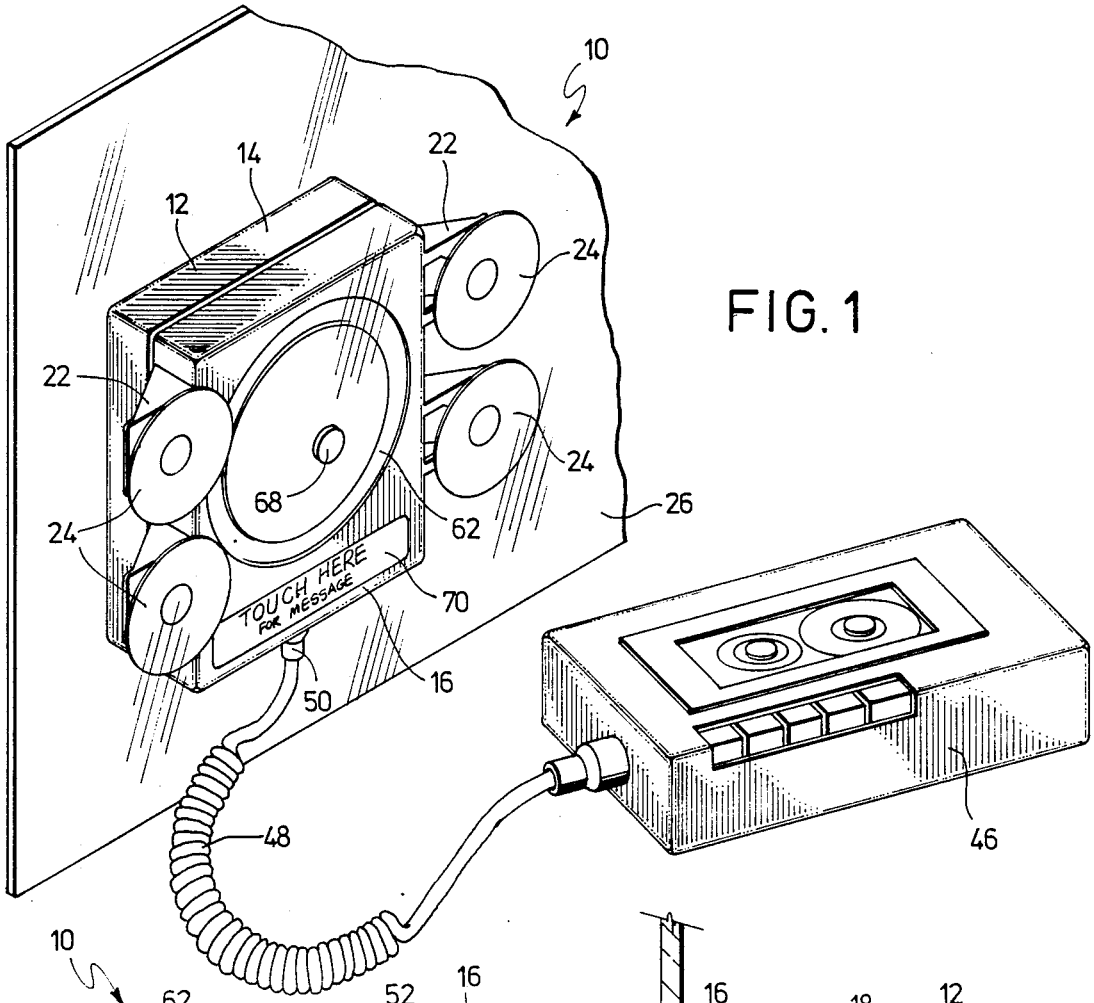
FIG. 1 is a perspective view of applicant's sound producing system mounted on a glass sounding surface.
Figure 2:
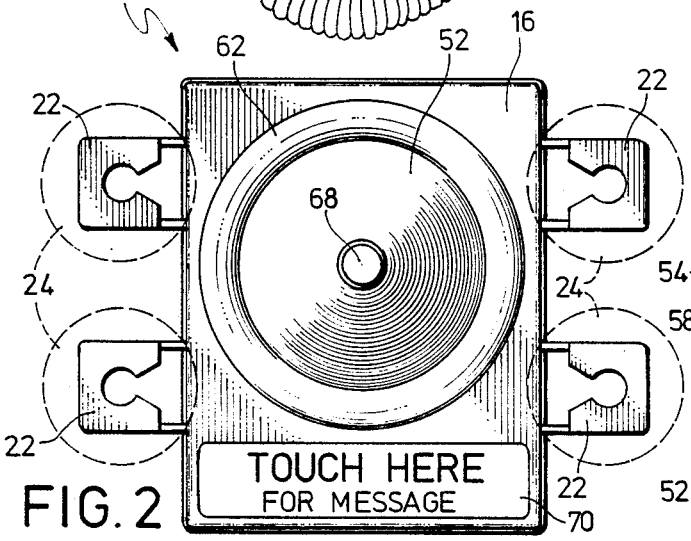
FIG. 2 is a plan view of applicant's sound producing system.
Figure 5:
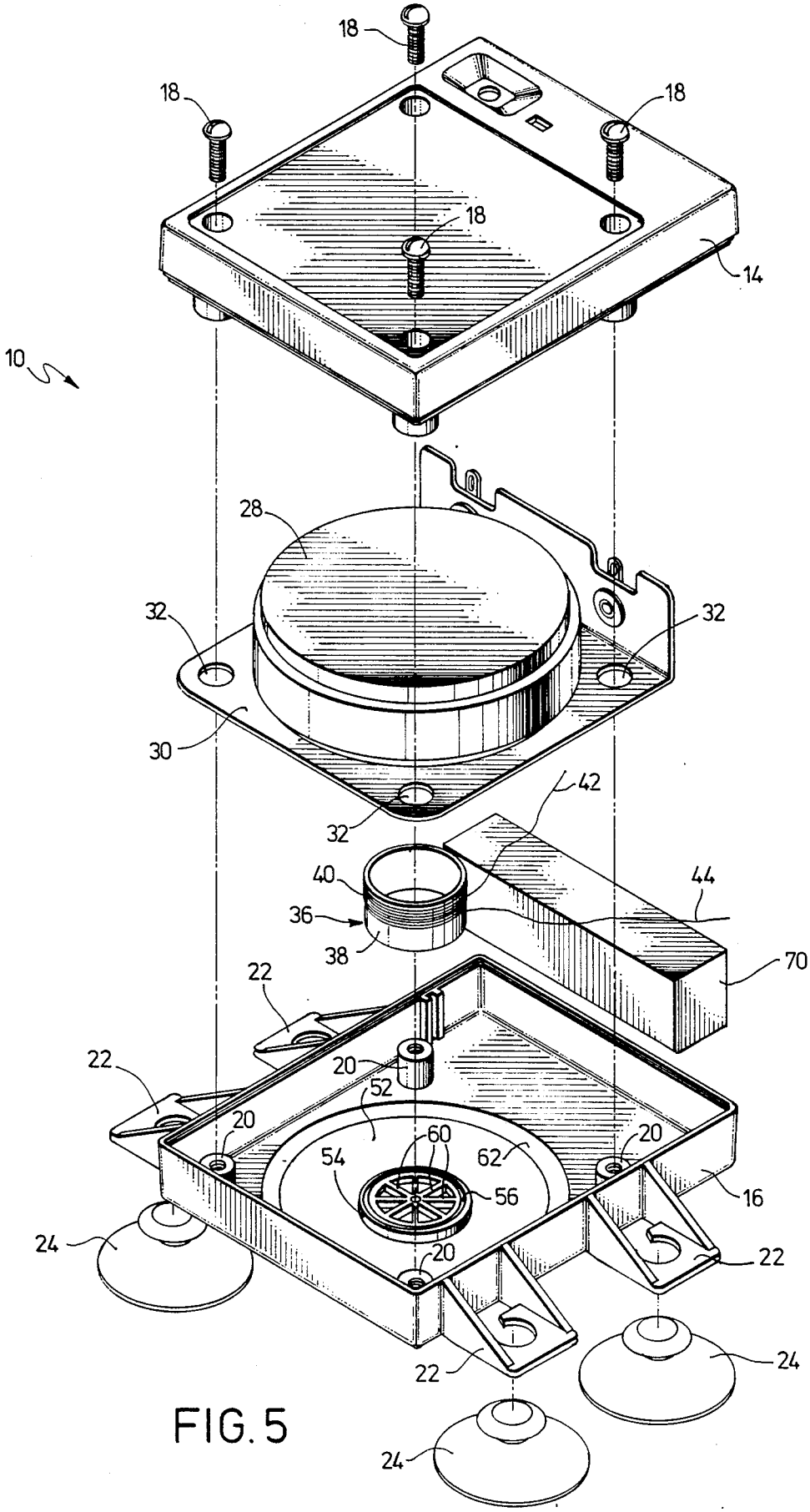
FIG. 5 is an exploded view of applicant's sound producing device.

Referring now to the drawings in which like reference characters designate like or corresponding parts throughout the several views. There is shown in FIG. 1 a transducer assembly 10 embodying one form of the invention. The transducer 10 has a housing 12 which contains the elements of the transducer 10. Housing 12 is formed in two parts 14 and 16 which are attached together in a clam shell relationship by screw fasteners 18, as shown. Screw fasteners 18 are received in bosses 20 in housing member 16, as shown. Housing member 16 is also provided with a plurality of brackets 22 for mounting the transducer 10 to a sounding surface. As shown in FIG. 5, brackets 22 may be provided with suction cups 24 which may be used to removably attach the transducer 10 to a sounding surface. In FIG. 1 transducer 10 is shown attached to a glass sounding surface 26 by means of suction cups 24 and brackets 22.

Figure 4:
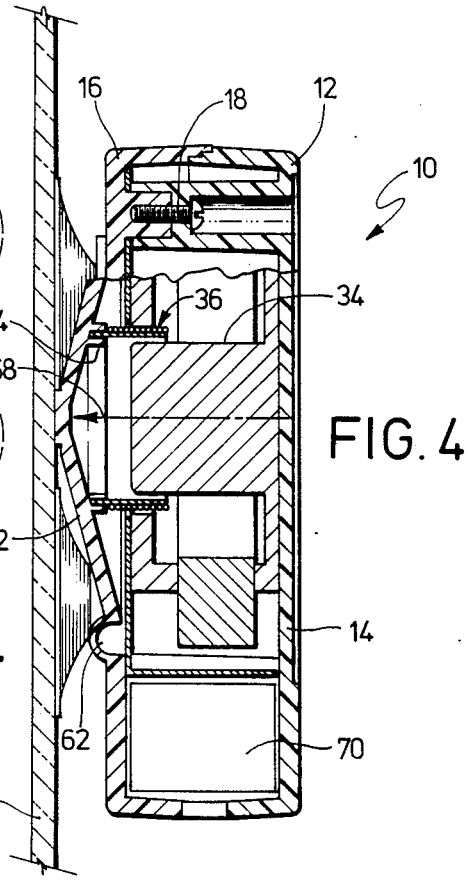
FIG. 4 is a cross-section of applicant's device partially broken.

As shown in FIGS. 4 and 5, transducer 10 includes a relatively large field magnet 28 mounted on plate 30. Field magnet 28 and plate 30 are mounted in housing 12. Mounting plate 30 has a plurality of holes 32 at the corners thereof, as shown. Holes 32 fit over bosses 20 in portion 16 of housing 12. When portions 14 and 16 of housing 12 are joined by screw fasteners 18, plate 30 and field magnet 28 are fixed in the housing 12. Field magnet 28 includes a central cylindrical portion 34, as shown in FIG. 4. Electromagnet voice coil 36 fits in housing 12 and is positioned adjacent to cylindrical projection 34, as shown. It will be appreciated that voice coil 36 in this position is under the influence of the magnetic field generated by permanent magnet 28, 34. Voice coil 36 includes a hollow cylindrical base 38 on which a coil of wire 40 is wound, as shown. The coil wire 40 has leads 42 and 44 which are connected to a source of electrical impulses, such as a cassette recorder/player 46, by conventional means such as a coaxial cable 48, a jack and plug connector 50 and conventional wiring, not shown. Voice coil 36 is positioned closely adjacent to cylindrical projection 34 to minimize the air gap losses in the magnetic field generated by field magnet 28, 34.

Housing 12 and portion 16 thereof include a semirigid vibration transmitting baffle 52, which is preferably formed integrally with portion 16 of housing 12. The vibration transmitting baffle 52 is preferably molded integrally with portion 16 by conventional molding processes. Sound transmitting baffle 52 is provided with an annular boss 54 on the inside of housing portion 16. Annular boss 54 includes a recessed annular groove 56 therein, as shown for example in FIG. 4. The base cylinder 38 of voice coil 36 is received in annular recess 56, as shown in FIG. 4. The connection between voice coil 36, vibration transmitting baffle 52, annular groove 56 and base cylinder 38 provides a vibration transmitting connection between voice coil 36 and vibration transmitting baffle 52. The vibrations generated by the movement of voice coil 36 under the influence of a signal from a source of electrical impulses, such as 46, are directly transmitted to vibration transmitting baffle 52. The connection between base cylinder 38 and annular recess 56 retains the voice coil 36 firmly and resists any tendency of the voice coil 36 to wobble or contact the cylindrical projection 34 of field magnet 28. This is particularly significant in view of the very small air gap between element 34 and voice coil 36. By restraining voice coil 36 the motion of voice coil 36 is substantially restricted to linear motion in a direction defined by the axis of voice coil 36. That is, in the direction shown by arrow 58 in FIG. 4. It will be appreciated that this movement is vibratory and includes motion both to the left and right as shown in FIG. 4. Voice coil 36 is otherwise restrained from motion transverse to its axis as defined by arrow 58.

Vibration transmitting baffle 52 is provided with a plurality of reinforcing ribs 60, as shown in FIG. 5, which stiffen vibration transmitting baffle 52 and assist in preventing transverse motion of the voice coil 36 and of vibration transmitting baffle 52. As shown in FIGS. 4 and 5, vibration transmitting baffle 52 is provided by an annular bellows fold 62 which defines the periphery of vibration transmitting baffle 52 and is the locus of its connection to portion 16 of housing 12. Annular bellows 62 has a U-shaped form in cross-section, as shown in FIG. 4. This bellows shape permits vibration transmitting baffle 52 to move coaxially along axis 58 substantially as a rigid unit. It will be appreciated that stiffening ribs 60 also assist in maintaining the rigid character of vibration transmitting baffle 52. Moreover, the folded U-shape of bellows portion 62 resists motion by vibration transmitting baffle 52 transverse to axis 58, so that the motion of vibration transmitting baffle 52 and voice coil 36 as connected thereto is coaxial.

Figure 3:
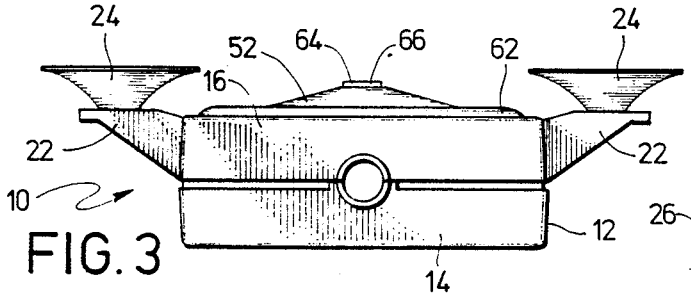
FIG. 3 is a top view of the device shown in FIG. 2.

As shown in the drawings, for example FIG. 3, vibration transmitting baffle 52 has a conical form which converges outwardly from its periphery at bellows 62 to its center 64. Vibration transmitting baffle 52 terminates in a truncated portion 66 at its center 64. Truncated portion 66 has a flat face 68 as shown in FIG. 1. When the transducer assembly 10 is mounted on a sounding surface, for example the inner surface of a display case such as glass panel 26 by suction cups 24, surface 68 is placed in firm contact with the sounding surface, that is glass plate 26. In this position the vibration from vibration transmitting baffle 52 is transmitting directly to the sounding surface, that is glass plate 26. Or, the glass plate 26 may be vibrated by outside sound waves, and the vibration is transmitted from the plate 26 to and through baffle 52 to the voice coil 36.

The transducer assembly 10 is also provided with a means to switch the source/receiver of electronic impulses, such as cassette recorder/player 46, on and off. Switching may be by direct action on the part of an audience or may occur automatically on sensing the presence of an audience. This switching mechanism is indicated in schematic as 70 and may consist of any conventional switching mechanism including those which are effective to operate the source of electronic impulses 46 through the sounding surface 26. These switching sources 70 may particularly include any of the conventional proximity sensors of the types which are common in burglar alarms and other similar devices. These switching devices may operate either by detecting the presence of heat or infrared radiation, motion, radar transmitter loading or vibration or may be operated by pressure or touch as is known in the art.

OPERATION OF THE DEVICE

It will be appreciated that the transducer assembly 10 does not include the conventional loud speaker sound cone. By eliminating the conventional loud speaker cone, applicant has produced a much more compact transducer assembly. Applicant's new transducer is economical and is much less susceptible to damage from abuse and from the environment.

Sound is produced or received by applicant's transducer by transmitting the vibrations from or to the voice coil 36 through vibration transmitting baffle 52 directly to or from a sounding surface 26. Sounding surface 26 may be any semicompliant surface, such as thin plywood, sheet metal or glass. Applicant's transducer is particularly useful in display cases, such as in museums and in outdoor displays. The transducer 10 may be mounted on the interior of the display case where it is relatively protected from abuse and the environment. Yet, by using a remote sensor 70 applicant's transducer 10 may be effectively switched on and off as desired without the necessity of a mechanical connection passing through the sound producing surface 26. The conventional back stop surface, to absorb the opposing motion as in a conventional loud speaker, is not necessary with applicant's design. The relationship of the kinetic mass of the transducer 10 to the frequency of audio signals is sufficient to effectively dampen opposing motion. When the transducer assembly 10 is used as a sound receiver, the recorder/player 46 may be actuated to begin recording by the proximity sensor 70, or the recorder/player 46 may include conventional sound activation circuitry that monitors incoming sound and activates the recorder when the incoming signals reach a sufficient magnitude. Of course, the assembly 10 could also be designed to monitor incoming sound constantly.

It will be appreciated by those skilled in the art that the particular embodiments shown herein are given for purposes of illustration and that various changes and modifications may be made to the embodiments disclosed without departing from the spirit of the invention. Applicant's invention is to be limited only by the scope of the claims appended hereto.

I claim:

1. A sound transducer for converting energy between electrical signals and sound comprising a housing, a field magnet mounted in the housing the field magnet producing a magnetic field in the space surrounding the field magnet, a voice coil positioned adjacent to the field magnet and a location under the influence of the field produced by the field magnet, and a vibration transmitting baffle connected to the voice coil and arranged substantially coaxially with the voice coil, the vibration transmitting baffle including means defining a generally conically-shaped portion and a bellows fold extending along the periphery of the larger end of the conically-shaped portion so that the shape of the conically-shaped portion and the bellows fold cooperate to limit transmitted vibration of the conically-shaped portion to movement along a substantially linear path oriented along the axis of the voice coil;

the vibration transmitting baffle including means for evenly contacting a sounding surface and the conically-shaped portion of the vibration transmitting baffle including a truncated portion which is truncated at a location near the apex of the conically-shaped portion, the truncated portion defining a substantially flat surface extending transverse to the axis of the voice coil, and the substantially flat surface providing said means for evenly contacting a sounding surface.

2. The device of claim 1 wherein the bellows fold is shaped to stabilize the voice coil.

3. The device of claim 1 wherein the bellows fold is shaped to maintain an edge of the vibration transmitting baffle in a relatively stationary condition and to thereby restrict motion of the conically-shaped portion to motion in a substantially linear direction along the axis of the voice coil.

4. The device of claim 2 wherein the vibration transmitting baffle includes means defining stiffening ribs extending along the conically-shaped portion.

5. The device of claim 4 wherein the ribs extend radially outward from a location situated near the center of the conically-shaped portion of the vibration transmitting baffle.

6. The device of claim 1 wherein the vibration transmitting baffle and housing are formed as a single unitary structure.

7. The device of claim 1 wherein the bellows fold is shaped to resist motion of said conically-shaped portion transverse to the axis of the voice coil.

8. The device of claim 1 wherein the conically-shaped portion of the vibration transmitting baffle extends outwardly from the housing and wherein the conically-shaped portion of the vibration transmitting baffle converges in the outwardly extending direction.

9. The device of claim 1 wherein the sound transducer has means for mounting the sound transducer to a sounding surface.

10. The device of claim 9 wherein the sound transducer has suction cup means for removably mounting the sound transducer to a sounding surface, the suction cup means being located on the housing and being positioned to maintain the vibration transmitting baffle in contact with and in cooperation with a sounding surface when the sound transducer is mounted thereon.

11. The device of claim 1 wherein the sound transducer includes means for connecting the voice coil of the sound transducer to an input source of information in electrical impulse form.

12. The device of claim 11 wherein the sound transducer includes switch means for activating the connecting means.

13. The device of claim 12 wherein the switch means includes a proximity sensor for sensing the presence of an object within a selected proximity of the sensor.

14. The device of claim 12 wherein the switch means includes a proximity sensor of the vibration sensing type.

15. The device of claim 13 wherein the proximity sensor is of the motion sensing type.

16. A sound transducer for converting energy between electrical signals and sound comprising a housing, a field magnet mounted in the housing, the field magnet producing a magnetic field in the space surrounding the field magnet, a voice coil positioned adjacent to the field magnet and a location under the influence of the field produced by the field magnet, means for connecting the voice coil of the sound transducer to an input source of information in electrical form, switch means for activating the connecting means, a vibration transmitting baffle connected to the voice coil and extending outwardly in a direction substantially coaxially with the voice coil, the vibration transmitting baffle including means defining a generally conically-shaped portion and a bellows fold extending along the periphery of the larger end of the conically-shaped portion so that the shape of the conically-shaped portion and the bellows fold cooperate to limit transmitted vibration of the conically-shaped portion to movement along a substantially linear path oriented along the axis of the voice coil, and means for mounting the sound transducer to a sounding surface;

the vibration transmitting baffle including means for evenly contacting a sounding surface and the conically-shaped portion of the vibration transmitting baffle including a truncated portion which is truncated at a location near the apex of the conically-shaped portion, the truncated portion defining a substantially flat surface extending transverse to the axis of the voice coil, and the substantially flat surface providing said means for evenly contacting a sounding surface.

17. The device of claim 16 wherein the conically-shaped portion of the vibration transmitting baffle extends outwardly from the housing and wherein the conically-shaped portion of the vibration transmitting baffle converges in the outwardly extending direction.

18. The device of claim 16 wherein the sound transducer has suction cup means for removably mounting the sound transducer to a sounding surface, the suction cup means being located on the housing and being positioned to maintain the vibration transmitting baffle in contact with and in cooperation with a sounding surface when the sound transducer is mounted thereon.

19. The device of claim 16 wherein the switch means includes a proximity sensor for sensing the presence of an object within a selected proximity of the sensor.

20. The device of claim 19 wherein the switch means includes a proximity sensor of the vibration sensing type.

21. The device of claim 19 wherein the proximity sensor is of the motion sensing type.

22. A sound transducer for converting energy between electrical signals and sound comprising a housing, a field magnet mounted in the housing, the field magnet producing a magnetic field in the space surrounding the field magnet, a voice coil positioned adjacent to the field magnet and in a location under the influence of the field produced by the field magnet, and a vibration transmitting baffle connected to the voice coil and extending outwardly in a direction substantially coaxially with the voice coil, the vibration transmitting baffle including means for maintaining transmitted vibration in a substantially linear direction along the axis of the voice coil, the vibration transmitting baffle being conical in shape, extending outwardly from the housing, being truncated at a location near the apex thereof and having a substantially flat surface extending transverse to the axis of the voice coil, and the substantially flat surface adapted to contact a sounding surface.

* * * * *